US007383754B2

(12) United States Patent
Rebordinos Villalba

(10) Patent No.: US 7,383,754 B2
(45) Date of Patent: Jun. 10, 2008

(54) BOTTLE OPENER

(76) Inventor: Pedro Maria Rebordinos Villalba, Prat De Sant Marti, 22, Gessa Naut Aran (ES)

( * ) Notice: Subject to any disclaimer, the term of this patent is extended or adjusted under 35 U.S.C. 154(b) by 0 days.

(21) Appl. No.: 11/596,485

(22) PCT Filed: May 12, 2005

(86) PCT No.: PCT/ES2005/000260

§ 371 (c)(1),
(2), (4) Date: Nov. 13, 2006

(87) PCT Pub. No.: WO2005/110911

PCT Pub. Date: Nov. 24, 2005

(65) Prior Publication Data

US 2007/0256521 A1 Nov. 8, 2007

(30) Foreign Application Priority Data

May 13, 2004 (ES) ..... 200401151

(51) Int. Cl.
*B67B 7/16* (2006.01)
*B67B 7/00* (2006.01)

(52) U.S. Cl. ..... 81/3.25; 81/3.27

(58) Field of Classification Search ..... 81/3.07, 81/3.25, 3.27, 3.4; D8/37
See application file for complete search history.

(56) References Cited

U.S. PATENT DOCUMENTS 943,759 A * 12/1909 Vaughan ..... 81/3.27
1,029,645 A * 6/1912 Vaughan ..... 81/3.27
1,393,029 A * 10/1921 Kryzanowsky ..... 81/3.27
1,500,881 A * 7/1924 Moriarty ..... 81/3.27
1,500,882 A * 7/1924 Moriarty ..... 81/3.27
1,707,804 A * 4/1929 Haase ..... 81/3.4
1,975,472 A * 10/1934 Mosgrove et al. ..... 81/3.27
1,988,057 A * 1/1935 Thompson ..... 81/3.25
2,542,295 A 2/1951 Spraker
2,591,527 A * 4/1952 Famely ..... 81/3.27
2,593,053 A * 4/1952 Porter, Jr. ..... 81/3.27
2,620,691 A 12/1952 Gould
2,649,004 A 8/1953 Trimble, Sr. et al.
2,674,909 A 4/1954 Morris
2,759,382 A * 8/1956 Carp ..... 81/3.08
2,810,311 A * 10/1957 Smith ..... 81/3.4
2,850,800 A * 9/1958 Carlson ..... 30/446
4,085,632 A * 4/1978 Hogan et al. ..... 81/3.25
D257,318 S * 10/1980 Zorzi ..... D8/18
D258,192 S * 2/1981 Maloney ..... D8/18
5,265,501 A * 11/1993 Reyes ..... 81/3.08
5,664,466 A * 9/1997 Miller ..... 81/3.25

FOREIGN PATENT DOCUMENTS

ES 129605 9/1967
GB 1109226 4/1968

* cited by examiner

*Primary Examiner*—David B Thomas
(74) *Attorney, Agent, or Firm*—Ladas and Parry LLP

(57) ABSTRACT

Decapper consisting of a monopiece body, configured with a straight profile of angular section and symmetrical, whose sides have flaps that are noticeably arched inwards, ending in sharp edges, in such a way that in both directions they make it possible to retain the edges of the crown-type bottle caps, so that they may be decapped through a levering or movement of the bottle in question.

7 Claims, 2 Drawing Sheets

BOTTLE OPENER

OBJECT OF THE INVENTION

The invention refers to a decapper, in other words to a device especially conceived to remove caps or sealing lids from bottles, of the type commonly referred to as "crown" caps.

The object of the invention is to obtain a static decapper, destined to form part of a likewise static support, for example a bar or counter of a public establishment that serves drinks, such as a bar, restaurant, cafeteria or similar; a decapper that with an extremely simple and consequently inexpensive structuring, offers numerous advantages.

BACKGROUND TO THE INVENTION

As is known, caps or crown caps used for closing bottles materialize in a metal disk, with a suitably coated internal face, which is fixed through stapling to bottle rims, defining a perimeter skirt with a dented profile. To eliminate these caps, decappers are used that, leaning against a margin region of the cap base, act by levering against the opposite edge of the skirt causing the cap's deformation and removal.

There are innumerable solutions to achieve this decapping effect, each and every one materializing in a manual implement or device that, acting as a lever, makes it possible to perform the previously described manoeuvre.

These implements present a two-sided problem:

On the one hand, they constitute a portable implement, of a reduced size, which is easily lost, meaning that frequently a waiter needing to use the decapper does not remember where it was left the last time it was used, with the ensuing loss of time required to find it. To solve this problem, often a piece of string is used or a chain that attaches the decapper to the user, for example to the belt strap or hook in a pair of trousers, which is an unaesthetic and not very practical solution.

To decap the bottle, both hands are needed, one to hold the bottle and another with which to activate the decapper, and even then there is a permanent risk of the bottle swaying during the manoeuvre and partially spilling its content.

In an attempt to avoid this problem static decappers are known, that are designed to be fixed for example to an establishment's counter, which avoids the problem of having to find it, but in turn this solution presents a two-sided problem, on the one hand, devices for this purpose are complicated and costly, and on the other they cannot be used simultaneously by two or more people, adding to which frequently its location within the establishment while it may be convenient for one or some of its employees, may also be inconvenient for others.

DESCRIPTION OF THE INVENTION

The decapper proposed by the invention, with an extremely simple and consequently inexpensive structuring, resolves the previously described problems in a fully satisfactory manner in all of the aspects mentioned.

More specifically, the decapper belongs to the type of static decappers, in other words it is destined to be fixed to a counter, bar or similar, and consists of an angular profile, of indefinite length, whose branches finish in longitudinal flaps bent inwards determining respective sharp edges, noticeably coplanary, with the profile having on one of its branches at least a pair of end orifices, so that it may be screwed onto the edge of the counter, bar or element in question, while its other branch is a coplanary extension of the bar, counter, or similar.

Thanks to its special profile, the edge of the cap can be hooked on the edge of either of the two abovementioned flaps, and, by pressing the base of the cap on the other, a movement of levering the bottle will cause its automatic decapping.

This profile can have any length, in such a way that it allows various bottles to be decapped simultaneously, on the part of several or more waiters, and with an appropriate modularity can run the best part of the length of the bar, even its full length, in such a way that it is directly and immediately available in any point of the establishment where the decapper may be required.

DESCRIPTION OF THE DRAWINGS

To complement the description being made and with a view to contributing to a better understanding of the characteristics of the invention, according to a preferable example of its practical embodiment, we accompany as an integral part of this description, a set of drawings where, by way of illustration but not limitation, the following has been represented.

Finally.

PREFERABLE EMBODIMENT OF THE INVENTION

Figure 1:
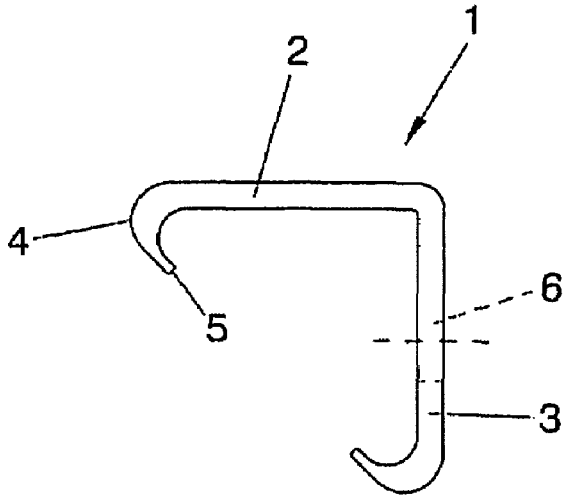
FIG. 1 shows the profile of a decapper realized in accordance with the object of the present invention.
Figure 2:
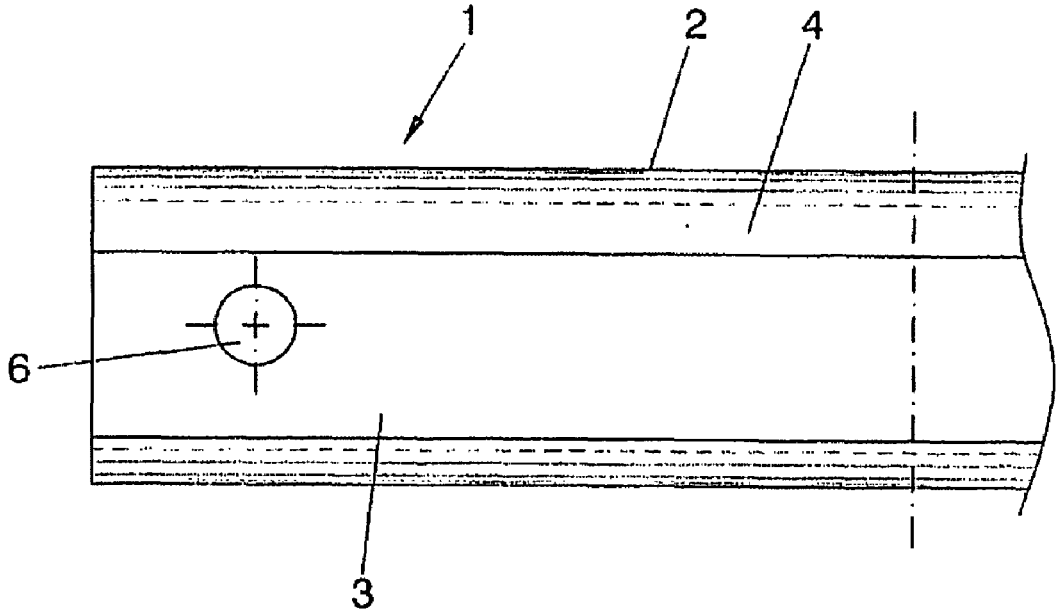
FIG. 2 shows a partial front elevation view of the same decapper.

From the abovementioned Figures it is possible to see how the decapper proposed by the invention consists of a monopiece body (1), of a constant profile, specifically a diedric profile and preferably straight, whose side branches (2) and (3) finish at their free end in corresponding flaps (4), noticeably arched inwards, and ending in sharp branches (5), that are left facing opposite each other as shown in FIG. 1.

Figure 3:
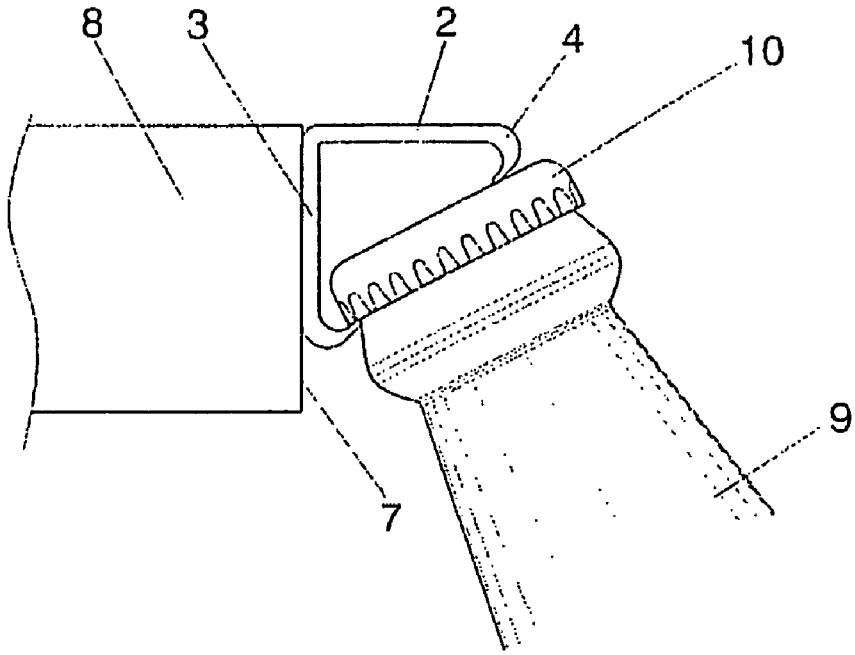
FIG. 3 shows the profile of the decapper of the previous figures duly fixed to the edge of a counter and in its operating position.

One of the side branches (3) of said body (1) has at least one pair of end orifices (6), whose number may be greater depending on the length of the body (1), length that in principle is indefinite, in such a way that through said orifices (6) and with the use of wall plugs or similar fixing devices, the decapper is attached to the inner edge (7) of a counter (8), bar or similar, of which the other branch (2) is a coplanary extension, as shown in FIG. 3.

As already mentioned above, the profile (1) may have any length considered suitable, in all events a considerable length, in such a way that what could be called a "running" decapper is obtained, capable of affecting even the full length of a counter's edge.

Figure 4:
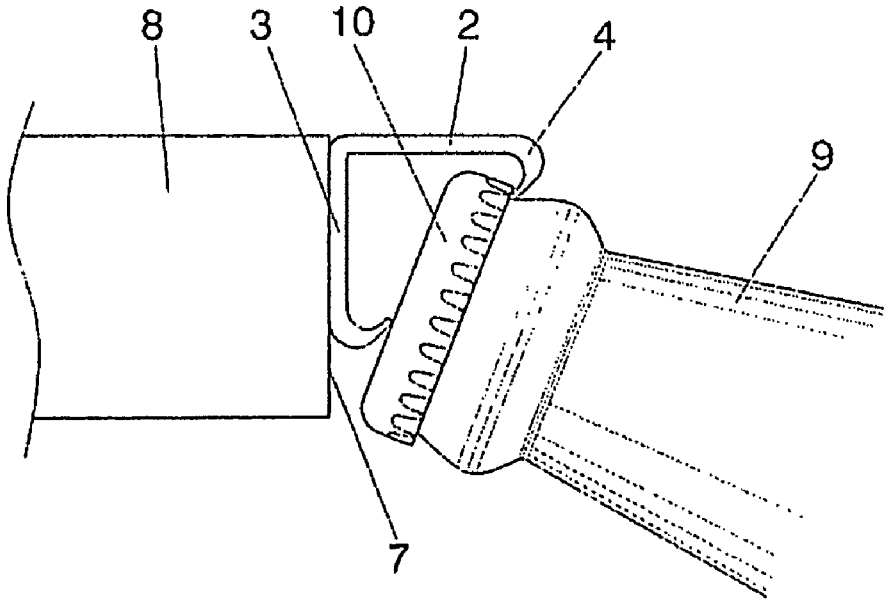
FIG. 4 shows a similar representation to FIG. 3 corresponding to a second possibility for using the decapper.

The device can be used in two ways, using always exclusively one hand to manipulate the bottle (9), one as shown in FIG. 3, in which the lower flap (4) of the decapper acts on the lower edge of the cap (10), supporting the latter on the flap (4) of the upper branch (2), and in which to eliminate the cap it is necessary to lever the bottle (9) in an upwards direction, and with another one shown in FIG. 4, opposite to the preceding one, in which the bottle (9) must be levered downwards in order for the bottle to be decapped.

The invention claimed is:

1. A bottle cap remover comprising a unitary body, said unitary body comprising first and second flanges disposed at a right angle to each other, each of the first and second flanges having a straight body portion and an arcuate end portion that tapers to an edge with the tapered edge of the first flange facing the tapered edge of the second flange and with the respective tapered edges of the first and second flanges spaced from each other to form a slot through which a skirt portion of a bottle cap can be inserted with a lower edge of the skirt portion contacting either the tapered edge of the first flange or the tapered edge of the second flange and with a base portion of the bottle cap disposed outside the slot and contacting the tapered edge of the first or second flange that is not contacting the skirt portion.

2. The bottle cap according to claim 1, wherein the first or second flange comprises orifice means for accommodating a screw for fixing the bottle cap remover to a worktop.

3. An assembly comprising the bottle cap remover of claim 1 and a worktop, the worktop comprising a top surface and a side surface forming a right angle with each other, the bottle cap remover being fixed to the worktop with the straight body portion of the first flange contacting the side surface of the worktop and with the straight body portion of the second flange extending from an edge of the worktop and being coplanar with the top surface of the worktop.

4. The assembly according to claim 3, wherein the bottle cap remover has a length that is the same length as the edge of the worktop.

5. The assembly according to claim 3, wherein the worktop is a counter or bar.

6. A method for removing a cap from a bottle comprising the steps of:

(a) providing the assembly of claim 3;

(b) inserting a skirt portion of the cap of the bottle through the slot of the bottle cap remover so that the skirt portion of the cap rests on the tapered edge of the first flange and a top portion of the cap contacts the tapered edge of the second flange; and (c) lifting the bottle in an upward direction to remove the cap from the bottle.

7. A method for removing a cap from a bottle comprising the steps of:

(a) providing the assembly of claim 3;

(b) inserting a skirt portion of the cap of the bottle through the slot of the bottle cap remover so that the skirt portion of the cap rests on the tapered edge of the second flange and a top portion of the cap contacts the tapered edge of the first flange; and (c) pushing the bottle in a downward direction to remove the cap from the bottle.

* * * * *